US008919828B2

(12) United States Patent
Barth et al.

(10) Patent No.: US 8,919,828 B2
(45) Date of Patent: Dec. 30, 2014

(54) LOCK UNIT COMPRISING TWO PAWLS AND POSITION DETECTION MEANS

(75) Inventors: Karsten Barth, Hattingen (DE); Thorsten Bendel, Oberhausen (DE); Serkan Gülkan, Hattingen (DE); Ulrich Weichsel, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 379 days.

(21) Appl. No.: 13/056,163

(22) PCT Filed: Jul. 29, 2009

(86) PCT No.: PCT/DE2009/001054

§ 371 (c)(1),
(2), (4) Date: Jan. 27, 2011

(87) PCT Pub. No.: WO2010/012272

PCT Pub. Date: Feb. 4, 2010

(65) Prior Publication Data

US 2011/0127780 A1 Jun. 2, 2011

(30) Foreign Application Priority Data

Jul. 31, 2008 (DE) ..... 10 2008 035 607

(51) Int. Cl.

| | |
|---|---|
| ***E05C 3/06*** | (2006.01) |
| ***E05B 85/24*** | (2014.01) |
| ***E05B 81/68*** | (2014.01) |
| *E05C 3/16* | (2006.01) |
| *E05B 81/20* | (2014.01) |

(52) U.S. Cl.

CPC ..... *E05B 85/243* (2013.01); *E05B 81/68* (2013.01); *E05B 81/20* (2013.01)

USPC ..... 292/216; 292/201

(58) Field of Classification Search

USPC ..... 292/201, 216

See application file for complete search history.

(56) References Cited

U.S. PATENT DOCUMENTS

| | | | | |
|---|---|---|---|---|
| 3,905,627 | A * | 9/1975 | Fujita | 292/216 |
| 4,203,621 | A * | 5/1980 | Noel et al. | 292/216 |
| 5,288,115 | A * | 2/1994 | Inoue et al. | 292/201 |
| 5,516,164 | A * | 5/1996 | Kobayashi | 292/201 |
| 5,564,761 | A * | 10/1996 | Mizuki et al. | 292/201 |
| 5,868,444 | A * | 2/1999 | Brackmann et al. | 292/201 |
| 5,938,252 | A * | 8/1999 | Uemura et al. | 292/201 |
| 6,601,883 | B1 * | 8/2003 | Kalsi | 292/216 |
| 6,659,515 | B2 * | 12/2003 | Raymond et al. | 292/201 |
| 7,475,922 | B2 * | 1/2009 | Ottino et al. | 292/216 |
| 2003/0080569 | A1 | 5/2003 | Raymond et al. | |
| 2010/0052336 | A1 * | 3/2010 | Bendel et al. | 292/196 |

FOREIGN PATENT DOCUMENTS

| | | | |
|---|---|---|---|
| DE | 197 36 445 | A1 | 2/1998 |
| DE | 199 37 405 | A1 | 2/2001 |
| DE | 10 2007 003 948 | A1 | 5/2008 |
| EP | 1 512 815 | A1 | 3/2005 |
| WO | 2008/145230 | A1 | 12/2008 |

* cited by examiner

*Primary Examiner* — Carlos Lugo

(74) *Attorney, Agent, or Firm* — Renner, Otto, Boisselle & Sklar, LLP

(57) ABSTRACT

A lock unit having at least one catch with a primary position and a first position, as well as a first pawl and a second pawl, wherein the first pawl cooperates with the catch in the primary position and the second pawl cooperates with the catch in the first position, and wherein position detectors are provided for both pawls.

5 Claims, 3 Drawing Sheets

LOCK UNIT COMPRISING TWO PAWLS AND POSITION DETECTION MEANS

CROSS-REFERENCE TO RELATED APPLICATIONS

This is a National Stage Application of International Patent Application No. PCT/DE2009/001054, with an international filing date of Jul. 29, 2009, which is based on German Patent Application No. 10 2008 035 607.7, filed Jul. 31, 2008.

BACKGROUND OF THE INVENTION

1. Field of the Invention

The present invention relates to a lock unit comprising at least one catch having a primary position and a first position, wherein the movement of the catch is blocked by at least a pawl, in the closed position. The invention finds particular application in motor vehicles for locking doors, hatches, etc.

2. Brief Description of the Related Art

Different embodiments of such lock units may be employed. It is possible, for example, that the locking of the catch is accomplished alone in the primary position by the pawl, wherein the arrangement of the catch and the pawl is chosen such that, for example, the contact force between the catch and the pawl is transferred about the pawl axis. Other embodiments are known, in which the pawl is not in a position to lock the catch in the primary position by itself. This is particularly true for the case in which the catch is spring-biased such that it tends to pivot to its open position at all times. In this case, the arrangement between the latch and the catch is such that the contact force between both parts of the locking mechanism is not transferred about an axis of rotation of the pawl, but rather the locking mechanism comprises a component oriented radially outward, which pushes the pawl. To ensure safe locking of the pawl in the primary position of the catch an additional blocking lever can be provided, which blocks the opening movement of the pawl.

In addition, lock units equipped with a so-called self-closing mechanism are known. The self-closing mechanism ensures that when the catch is moved into the first position, it is then actively pivoted from the first position into its primary position by means of a drive, especially an electric motor, while at the same time overcoming the force necessary to close the door against a door seal.

Moreover, it is considered advantageous to detect the closed position of the lock unit, i.e., when the pawl abuts the primary position of the catch, and then to turn on or off various functions of the motor vehicle. For example, in this way, open door indicator lights can be turned on or off on the dashboard. The automatic vehicle interior lighting may also be controlled, depending on the specific position or positions of the locking components, especially the catch and/or the pawl. When appropriate, the engine starter can be disabled until it is determined that all door lock parts of all doors have reached their locked position.

For this purpose, the location of the catch can be detected by means of microswitches. In particular, whether or not the catch has reached its latched position may be detected. Such systems work occasionally, however, with relatively large tolerances and often cannot handle extreme positions of the locking mechanism, such as the overtravel position, which is often realized in self-closing mechanisms. This can leads to misinterpretation of the sensor signals.

BRIEF DESCRIPTION OF THE INVENTION

On this basis, the present invention addresses the prior art problems, at least partially. In particular, a lock unit is realized, which, on the one hand ensures reliable operation of the lock unit when used in automotive settings, and, on the other hand, allows for the easy and safe detection of the position of the locking mechanism. A simple design for the lock unit is preferred.

These tasks are achieved with a lock unit having the features as in claim 1. Advantageous embodiments of the invention are given in the dependent claims. It should be noted that in the claims, individually listed features may be combined in any technologically sensible way to show further embodiments of the invention. The specification further illustrates the invention and shows additional embodiments, particularly in relation to the figures.

A lock unit of the invention comprises at least one catch having a primary position and a first position, as well as a first pawl and a second pawl, wherein the first pawl cooperates with the catch in the primary position and the second pawl cooperates with the catch in the first position, wherein position detection means are provided for both pawls.

The inventive lock unit assumes that the safety of the catch is ensured in both positions (i.e., in the "first position" and the "primary position") through a series of separate pawls that are movable with respect to one another. In certain positions, the pawls may carry out other functions in addition to blocking the catch so that, for example, in preferred embodiments, the second pawl is implemented as an operating lever that is actuated by an actuator.

The term "first position" is defined as a profile or a widening of the catch (in the circumferential direction), by means of which the catch can be blocked in a position between the open position and the closed position, wherein the first position also prevents the exit of the latch pin from the inlet opening.

Starting from this first position, the lock unit can be further rotated by the user and/or a drive until it has reached the closed position ("primary position"). To ensure that the first pawl cooperates with the primary position, the catch may be turned slightly excessively into a so-called overtravel position. Thus, the first pawl moves particularly silently and with a low force before reaching the primary position, particularly the profile or a widening of the catch (in the circumferential direction or perpendicularly thereto), and comes into contact with the primary position when the catch returns back from the overtravel position.

The position detection means are used for both pawls to detect the specific position of each. However, this invention moves away from determining more than two states for each pawl (open position, first position, primary position). In contrast, the number of latched positions per catch is reduced to facilitate obtaining exact results using the position detection means.

A preferred embodiment of the lock unit includes a single position detection means provided for both pawls. In particular, areas of the pawls that face away from the catch cooperate with the position detection means. The term "cooperate with" in this context means that the position detection means is arranged such that both positions of both pawls can be detected and correlated with one another. In the case in which separate sensors are used for detecting the position of the pawls, suitable connecting circuits (logical and electrical or physical) are employed for currents or signals produced by the sensors. The single position detection means is preferably also significantly spatially restricted, and it may also have its own housing. In particular, the single position detection means is an independent measuring apparatus that comes into physical contact with the first pawl and/or the second pawl at particular times. Because the positions of both pawls are determined in this spatially restricted area of the lock unit, very precise and redundant signals are available with respect to the current position of the first pawl and/or the second pawl, such that, in particular, all states of the lock unit can be queried ("open" position, "first" position, "primary" position, "overtravel" position). The query results can be used, in particular, to easily and safely activate or operate the self-closing mechanism and/or functions of the vehicle (lights, horn, etc.).

It is particularly preferred that the (common) position detection means comprises an actuatable switch. The detection of the positions of the pawls by means of the actuatable switch leads to a very robust arrangement with clearly identifiable signals because the signals correspond to only two states: active and not active. Logical processing of these (e.g., via suitable electrical conductors) leads to a simple design of a common position detection means.

The (common) position detection means is implemented particularly in the form of a so-called double microswitch. The actuatable switches can be, for example, two contact lugs arranged in parallel, which cooperate with a corresponding actuating profile of the first pawl or the second pawl. Particularly preferred is a microswitch that already includes logic used to convert the electric signal of the microswitch into a single redundant signal that is forwarded, for example, to a control unit of the motor vehicle and/or the lock unit.

According to an embodiment of the device, the first pawl is mounted on a first plane and the second pawl is mounted on a second plane, and the first pawl shares a common axis of rotation with the second pawl. In this way, a very compact design of the locking mechanism can be achieved. Due to the overlapping pivoting motions, the position and design of the common position detection means can be kept very small. It is preferred that the catch and the first pawl are disposed in a first plane, and (only) the (protruding) first position of the catch and the second pawl are disposed in an adjacent parallel plane. In this preferred embodiment, the two pawls are disposed on a common axis of rotation and rotate relative to one another.

In addition, is considered advantageous that the common position detection means is arranged such that it is inactive in this state of the lock unit, wherein the first pawl cooperates with the catch via the primary position. This means, in particular, that the common position detection means, for example in the form of an actuatable switch, is arranged such that there is no contact between it and the pawls in the closed state of the lock unit. In this way, in particular, the mechanical stress on the common position detection means can be reduced, thereby increasing the lifetime for such common position detection means.

Most preferably, the invention finds application in a motor vehicle, which comprises at least one such lock unit, e.g., at doors and/or hatches.

The invention and the technical background are explained in more detail hereinbelow with reference to the figures. It should be noted that the figures show preferred embodiments of the invention, but the invention is not limited to these embodiments

DETAILED DESCRIPTION OF THE INVENTION

Figure 1:
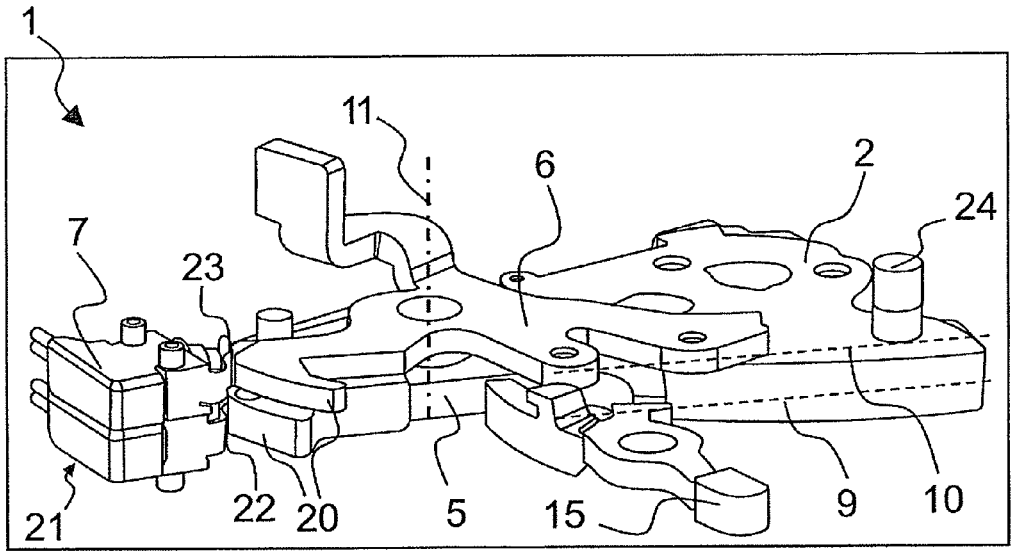
FIG. 1 shows a perspective view of the locking mechanism with a position detection means in a lock unit according to a first embodiment of the invention.

FIG. 1 shows a schematic perspective diagram of a locking mechanism comprising a catch 2, a first pawl 5 and a second pawl 6. The locking mechanism is arranged, for example, in the housing of a lock unit 1. The right hand side of the drawing shows the catch 2 in a closed position, in which the catch 2 is effectively engaged with the first pawl 5 in the "primary position." The first pawl 5 is rotatably arranged on an axis of rotation 1, and the second pawl 6 is also arranged on the same axis of rotation 11. Whereas the first pawl 5 and the catch 2 are arranged substantially on a first plane 9 and, thus, interact with each other principally through their peripheral surfaces, the second pawl 6 is arranged in a second plane 10 that lies above the first plane. Thus, an arrangement is created in which the second pawl 6 can swing across portions of the catch 2. The second pawl 6 and the catch 2 interact in such a way that the first position of the catch 2 has a protrusion that extends into the second plane 10. The protrusion is implemented as a pin connector 24, as shown in the right hand corner of FIG. 1.

The first pawl 5 is secured with a blocking lever 15 in this closed position such that the first pawl 5 is in constant contact with the catch 2. It follows that the first pawl 5 must be separated from the blocking lever 15 before the catch 2 can be pivoted toward the open position. The advance release of the blocking lever 15 occurs via the second pawl 6.

In a preferred embodiment, a single position detection means 7 is provided for both pawls, which are mounted on a common axis of rotation 11. The position detection means 7 is implemented in this embodiment as a so-called double-microswitch 21, which has a first contact lug 22 and a second contact lug 23. The two contact lugs 22, 23, which are oriented in parallel, cooperate as actuatable switches at certain times with a corresponding actuating profile 20 of the first pawl 5 and/or the second pawl 6. The double microswitch 21 is arranged opposite the catch 2 with respect to the axis of rotation 11 of the pawl and scans the actual position or location of the first pawl 5 and/or the second pawl 6 via the actuating profile 20 of the pawls.

In this way, the current position of the lock unit 1 is securely and redundantly determined, in particular, with reference to the below-described movements.

Figure 2:
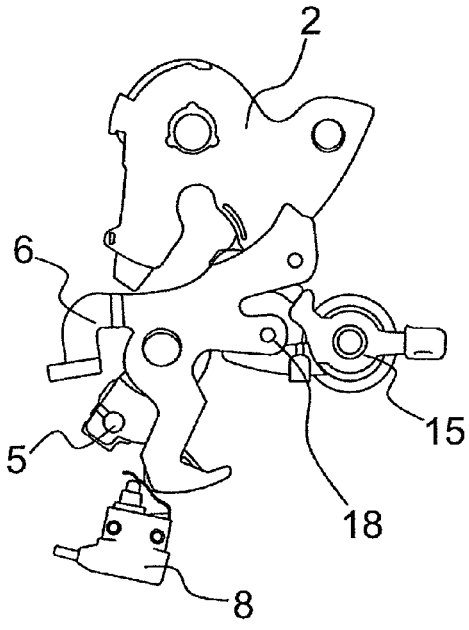
FIG. 2 shows a plan view of a locking mechanism in the "primary position" according to a further embodiment of the invention.
Figure 3:
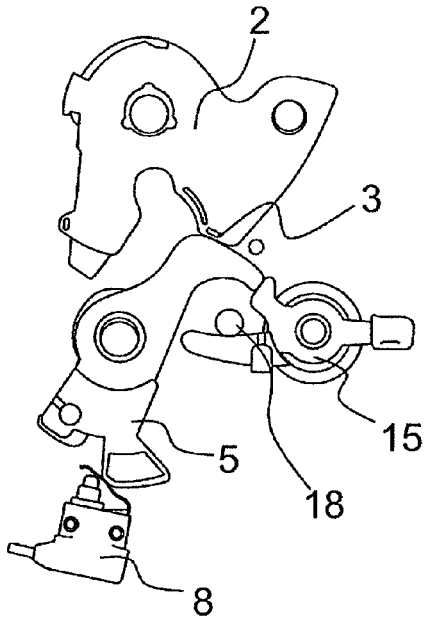
FIG. 3 shows the locking device of FIG. 2 with the second pawl omitted.

FIGS. 2 and 3 show an embodiment of the locking mechanism of the lock unit in a "primary position." FIG. 2 shows both pawls 5, 6, which overlap with respect to one another. In FIG. 3, the second pawl 6 is omitted to better illustrate the position of the first pawl 5.

The catch 2 is shown here in a closed position, in which the catch 2 with its primary position 3 sits closely against the first pawl 5. The contact surfaces are designed such that the spring-loaded catch 2 acts with an opening moment on the first pawl 5 because the contact force is not transferred via the axis of rotation 11 of the pawl. The blocking lever 15 secures the first pawl 5 in the primary position 3 by blocking the movement of the first pawl 5 in cooperation with a corresponding stop. The second pawl 6 comprises a driver 18, which rests against the blocking lever 15. Through actuation and a subsequent clockwise rotation of the second pawl 6, the driver 18 can pivot the blocking level 15 in the counterclockwise direction. Thus, the contact of the blocking lever 15 with the first pawl 5 is released and, independently, the catch 2 pushes away the first pawl from the primary position 3.

Preferably, the two pawls share a common position detection means in the form of an actuatable switch 8. The top view shows that the actuatable switch 8 is implemented as a double microswitch 21 with contact lugs 22, 23. It may also be seen that the positions of the first pawl 5 and the second pawl 6 in the closed position are such that the actuatable switch 8 is inactive, i.e., no forces are transferred via one of the pawls on the actuatable switch 8.

Figure 4:
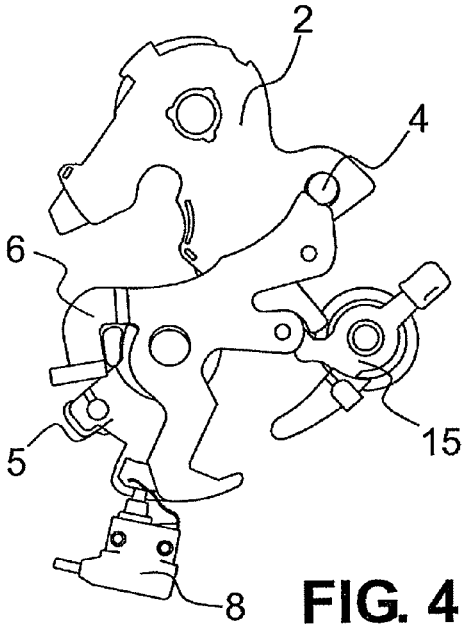
FIG. 4 shows the locking device of FIG. 2 in the first position.
Figure 5:
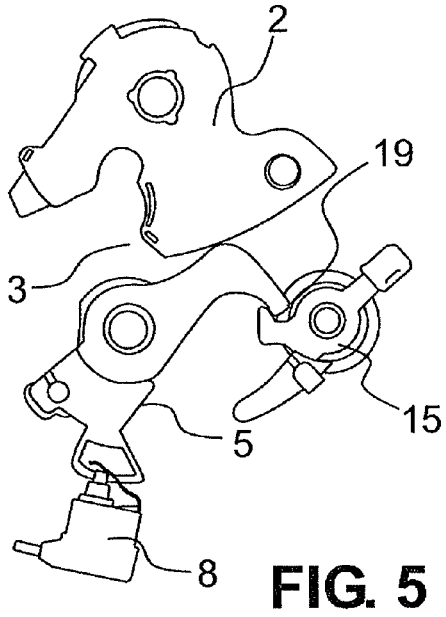
FIG. 5 shows the locking device of FIG. 4 with the second pawl omitted.

FIGS. 4 and 5 show the "first position." This position is assumed by the locking mechanism particularly during its closing movement when, for example, the door is pushed against the door seals of a motor vehicle with insufficient force. In this position, the first pawl 5 has not yet reached the primary position 3 of the catch 2, and the first pawl 5 is still in a different position on the periphery of the catch 2 and/or in a seat 19 of the blocking lever 15. Nonetheless, it is clear from FIG. 5 that the first pawl 5 acts in this deflected position on the part of the actuatable switch 8 allocated to the catch, such that the actuatable switch 8 is activated. The second pawl 6 located above is engaged with the catch 2 in this state, namely, via the first position 4. In this case, definite position detection is achieved in that the second pawl 6 is not engaged with the actuatable switch 8.

For example, using a closing aid, the catch 2 is actuated into a closed position by means of an electric motor, such that the contact between the first pawl 5 and the actuatable switch 8 is interrupted. Thus, the "first position" can be clearly differentiated from the "primary position."

Figure 6:
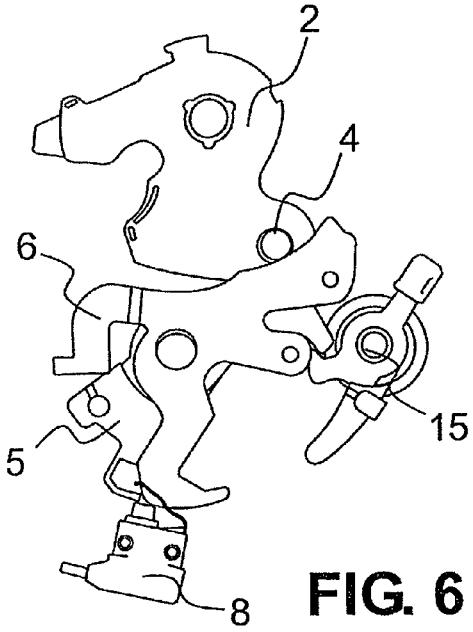
FIG. 6 shows the locking device of FIG. 2 in an open position.
Figure 7:
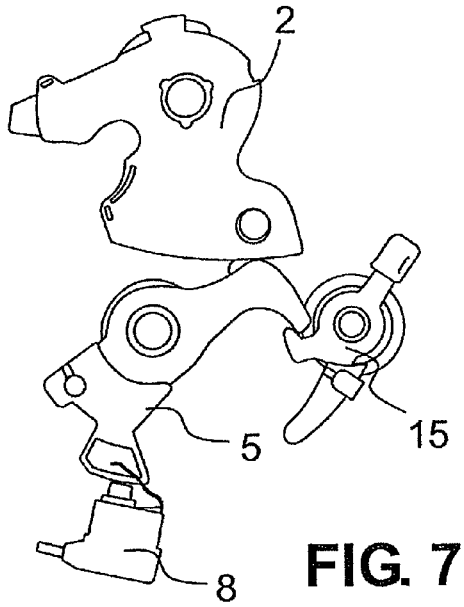
FIG. 7 shows the locking device of FIG. 6 with the second pawl omitted.

As shown in FIGS. 6 and 7, in the open position of the lock unit 1, both the first pawl 5 and the second pawl 6 are in direct contact with corresponding parts of the actuatable switch 8. In this position of the locking mechanism, both pawls lie on the outside, that is, in the circumferential regions of the catch 2. In this way, the catch 2 releases the catch bolt such that the corresponding door or hatch of the motor vehicle may be opened.

Due to the various individual sensing signals and chronological changes in the signals during opening and closing, data is acquired accurately, quickly, and redundantly and additional functions may be initiated to operate the vehicle and/or the lock unit, e.g., in connection with keyless entry systems and/or starters and/or the release of the ignition process.

Figure 8:
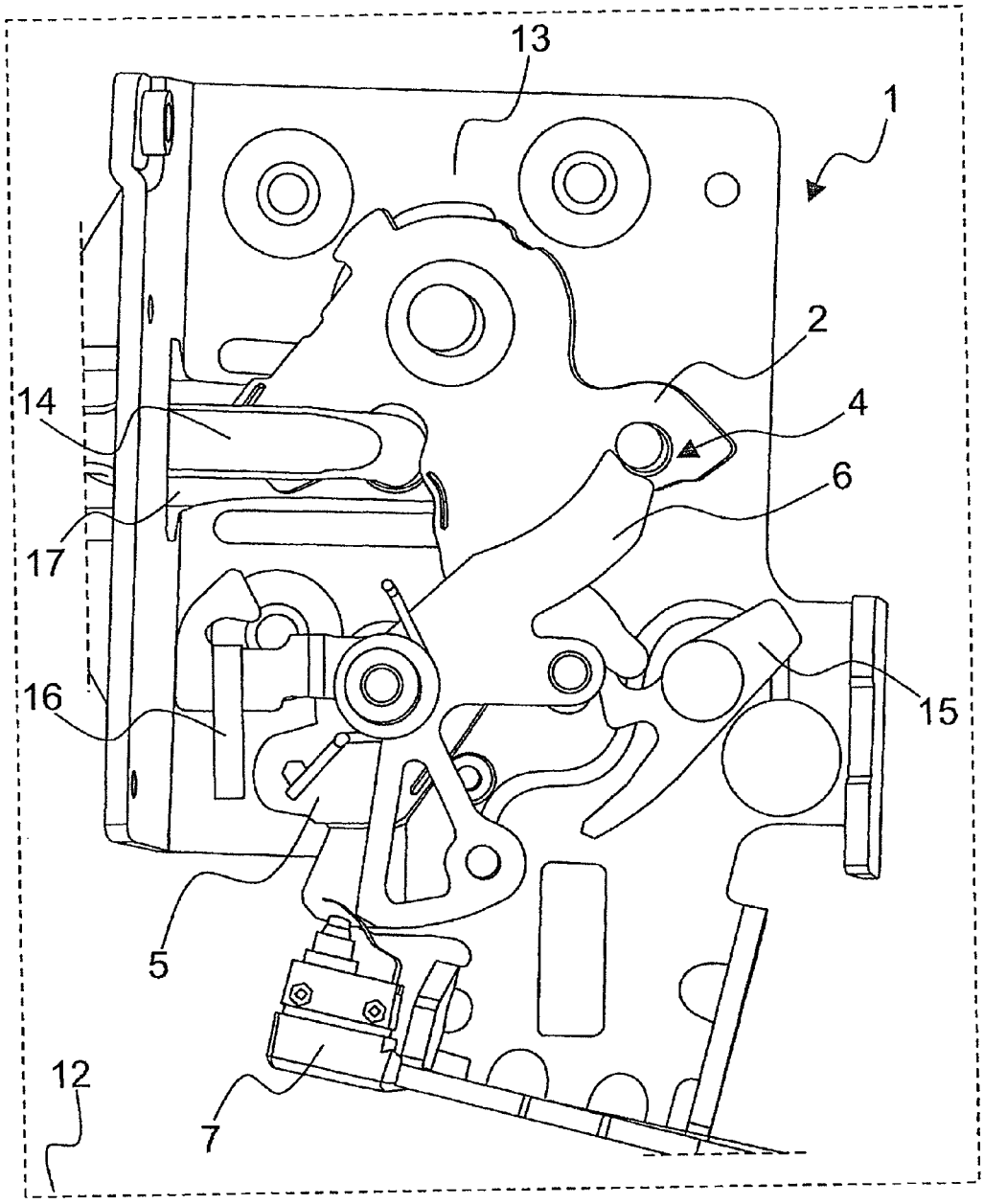
FIG. 8 shows a further embodiment of the inventive locking device.

FIG. 8 shows another embodiment of such a lock unit 1. Shown is the "first position" of the locking mechanism. In particular, the lock unit 1, which is installed in a motor vehicle 12, interacts with a locking bolt 14 mounted on the vehicle body. During the closing motion of the vehicle door, the locking bolt 14 enters the inlet opening 17 of the latch case 13 and is, thus, at least partially embraced and retained by the catch 2. The insertion of the locking bolt 14 rotates the spring-loaded catch 2 counterclockwise. The first pawl 5 is motivated to also turn in the counterclockwise direction, for example, by means of a spring-biased blocking lever 15, such that the first pawl 15 securely presses against the circumferential surface of the catch 2, then directly engages at the primary position during the closing operation. The second pawl 6 is also spring loaded such that it is preferably pivoted counterclockwise, wherein this rotational movement is limited. Shown here is the first position, at which the second pawl 6 interacts with the first position 4 of the catch 2. The self-closing mechanism may be employed herein to further pivot the catch 2 by means of an electric motor until the first pawl comes to rest at the primary position. An actuator 16 may also engage the second pawl 6, which allows, in particular, for the opening movement of the locking process to be initiated. Also mounted on the latch case 13 is a common position detection means 7 used to unambiguously determine the position of the first pawl 5 and the second pawl 6, such that information is obtained about the state of the lock unit 1.

REFERENCE LIST

1. Lock unit
2. Catch
3. Primary position
4. First position
5. First pawl
6. Second pawl
7. Common position detection means
8. Actuatable switch
9. First plane
10. Second plane
11. Axis of rotation of the pawl(s)
12. Motor vehicle
13. Latch case
14. Latch pin
15. Blocking lever
16. Actuator
17. Inlet opening
18. Driver
19. Seat
20. Actuating profile
21. Double microswitch
22. First contact lug
23. Second contact lug
24. Pin connector

The invention claimed is:

1. A lock unit comprising a catch with a primary position and a first position, as well as a first pawl and a second pawl, wherein the first pawl cooperates with the catch in the primary position and the second pawl cooperates with the catch in the first position, wherein position detection means are provided for both pawls, wherein said first pawl is disposed in a first plane and said second pawl is disposed in a second plane, and both pawls are disposed on a common axis of rotation, and wherein said position detection means is a double microswitch having respective contact lugs that are parallel to one another and positioned to engage the first and second pawls, respectively.

2. The lock unit of claim 1, wherein said position detection means is common to both pawls.

3. The lock unit of claim 1, wherein said position detection means comprises an actuatable switch.

4. The lock unit of claim 1, wherein said position detection means is disposed such that said position detection means is inactive when the first pawl interacts with said catch via said primary position.

5. A motor vehicle comprising at least one lock unit of claim 1.

* * * * *